US012565993B2

(12) United States Patent
Smith

(10) Patent No.: US 12,565,993 B2
(45) Date of Patent: Mar. 3, 2026

(54) CHIMNEY DAMPER ASSEMBLY

(71) Applicant: Darren Smith, Milwaukie, OR (US)

(72) Inventor: Darren Smith, Milwaukie, OR (US)

( * ) Notice: Subject to any disclaimer, the term of this patent is extended or adjusted under 35 U.S.C. 154(b) by 396 days.

(21) Appl. No.: 18/134,199

(22) Filed: Apr. 13, 2023

(65) Prior Publication Data

US 2024/0344699 A1 Oct. 17, 2024

(51) Int. Cl.
*F23J 13/08* (2006.01)

(52) U.S. Cl.
CPC ..... *F23J 13/08* (2013.01)

(58) Field of Classification Search
CPC . F23J 2213/50; F23J 13/08; F23J 2900/13005
USPC ..... 454/4–5
See application file for complete search history.

(56) References Cited

U.S. PATENT DOCUMENTS 4,554,863 A 11/1985 Dalsin
5,080,006 A 1/1992 Vonsick
5,160,291 A 11/1992 Sexton
5,437,574 A * 8/1995 Sexton ..... F23L 11/005 454/29
D381,743 S 7/1997 Szwartz
2009/0181609 A1* 7/2009 Thomas ..... F23L 17/10 110/163
2016/0252247 A1* 9/2016 Thomas ..... F23J 13/08 454/4

FOREIGN PATENT DOCUMENTS

CA 2498406 8/2005

* cited by examiner

*Primary Examiner* — Ko-Wei Lin

(57) ABSTRACT

A chimney damper assembly for allowing a user to control when the damper is closed or open includes a frame mounting to a top of a chimney. The frame is hollow, and a flange extends upwardly the frame. A panel is attached to the frame by a hinge and is pivotally positionable from an open position to a closed position. A loop connector is attached the panel, and a seal is attached to the frame to inhibit ventilation when the panel is in the closed position. A pulley includes a grooved wheel rotatably coupled to the flange. A tether is positioned upon the grooved wheel and is elongated from a first end to a second end. The first end of the tether is attached to the loop connector the panel, and the second end of the tether is pulled by a user to lift the panel into the open position.

9 Claims, 6 Drawing Sheets

CHIMNEY DAMPER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to chimney dampers and more particularly pertains to a new chimney damper for allowing a user to close the chimney damper to inhibit heat loss through the chimney or to open the chimney damper to provide ventilation for smoke within the chimney.

(2) Description of Related Art Including Information Disclosed Under 37 CFR 1.97 and 1.98

The prior art relates to chimney dampers and includes a variety of chimney dampers configured to mount to a top of a chimney and be partially open to ventilate smoke from the chimney. Known prior art does not allow a chimney damper being opened or closed when a user engages with a pulley in mechanical communication with the chimney damper.

BRIEF SUMMARY OF THE INVENTION

An embodiment of the disclosure meets the needs presented above by generally comprising a frame configured for mounting to a top of a chimney. The frame is hollow and includes a boundary wall having a top edge and a bottom edge each being open. A flange extends upwardly the frame, and a panel is pivotally coupled to the frame by a hinge. The panel is pivotally positionable from an open position wherein the panel allows access through the boundary wall of the frame to a closed position wherein the panel inhibits access through the boundary wall of the frame. A loop connector is attached the panel, and a seal is attached to the frame. The seal is configured to inhibit ventilation between the panel and the top edge of the boundary wall when the panel is positioned in the closed position. A pulley includes a grooved wheel rotatably coupled to the flange. A tether is positioned upon the grooved wheel and is elongated from a first end to a second end. The first end of the tether is attached to the loop connector the panel, and the second end of the tether is configured for being pulled by a user to lift the panel into the open position. A bumper is coupled to the first end of the tether and inhibits the panel from abutting the flange when the panel is positioned into the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
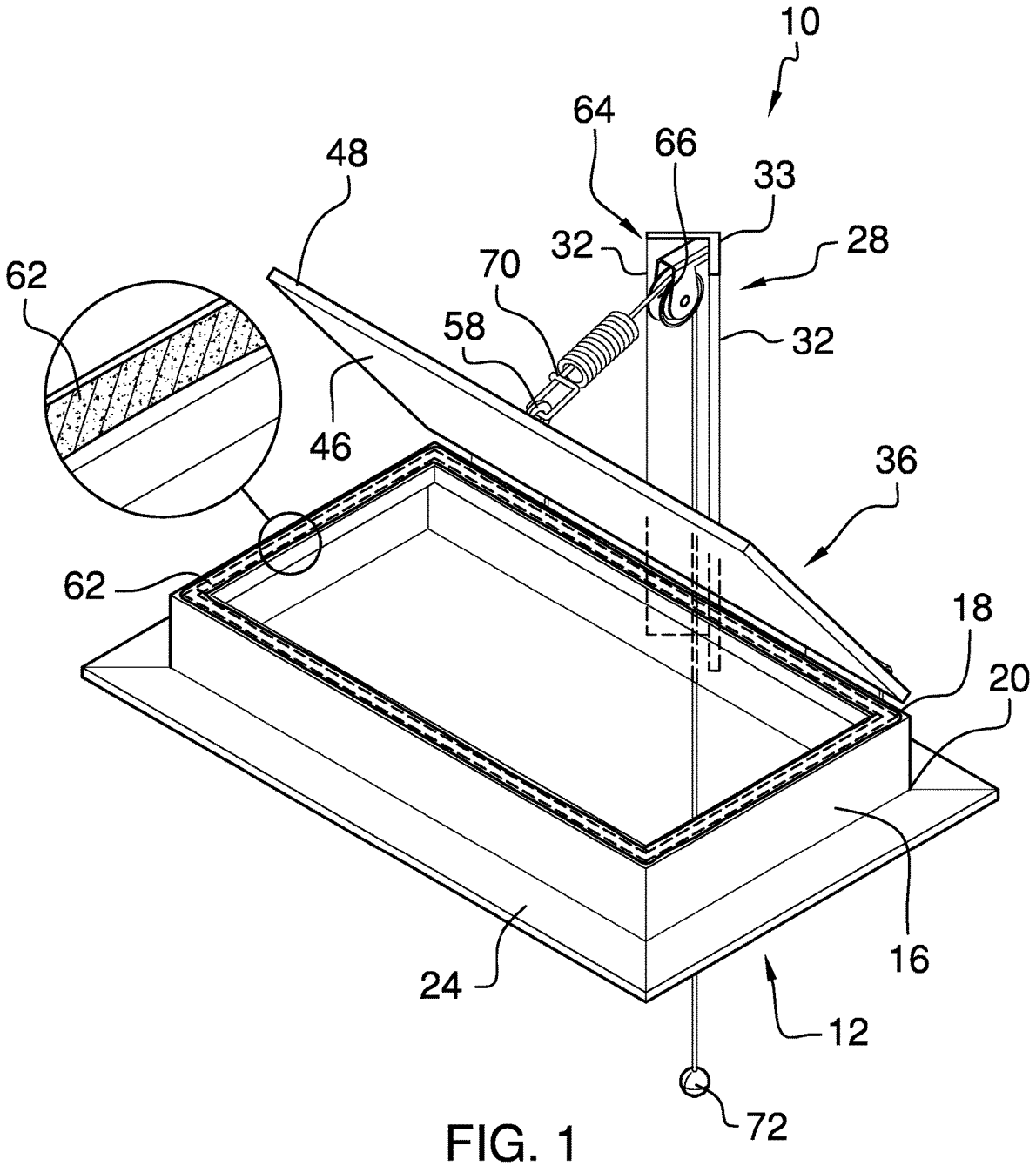
FIG. 1 is a top isometric view of a chimney damper assembly according to an embodiment of the disclosure.
Figure 2:
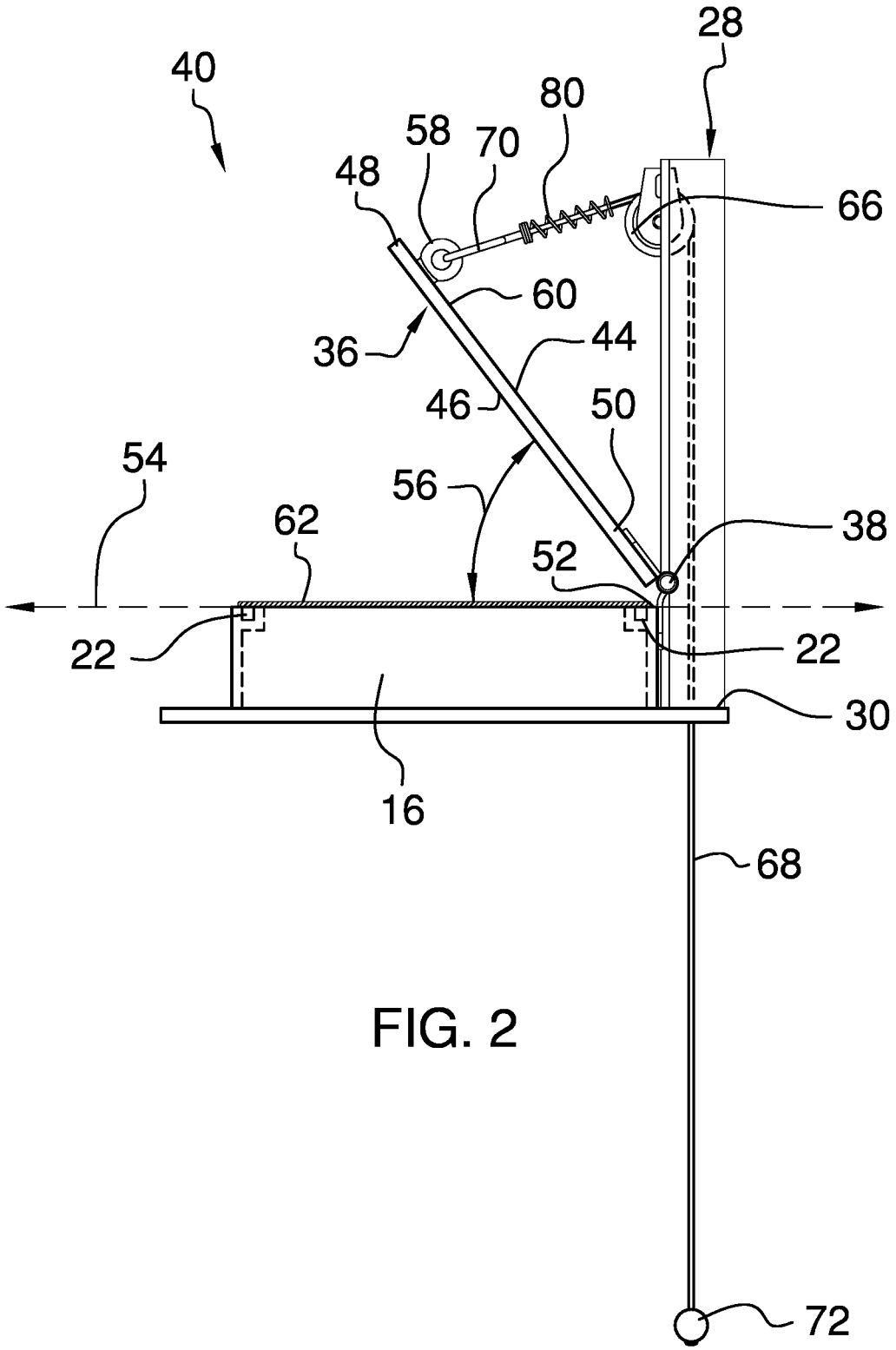
FIG. 2 is a side open view of an embodiment of the disclosure.
Figure 3:
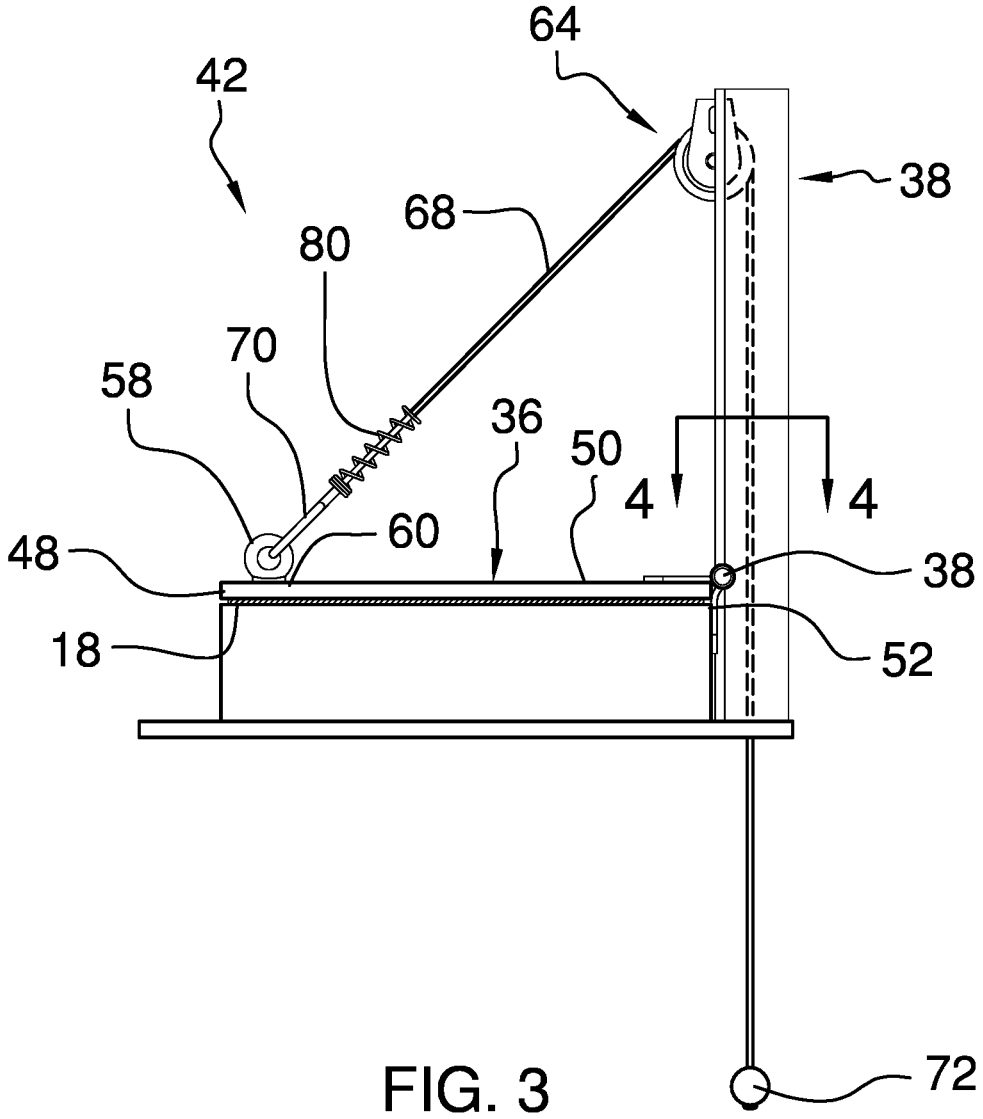
FIG. 3 is a side closed view of an embodiment of the disclosure.
Figure 4:
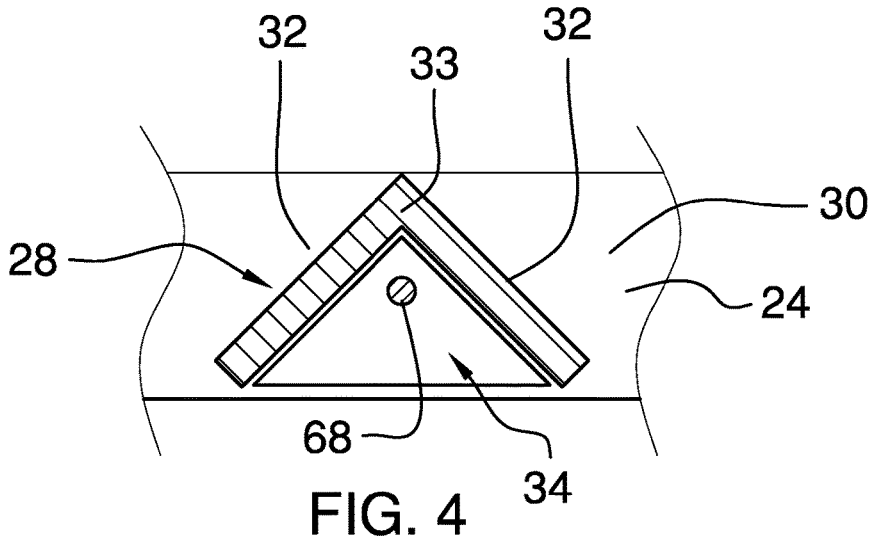
FIG. 4 is a cross-sectional view of an embodiment of the disclosure taken along Line 4-4 of FIG. 3.
Figure 5:
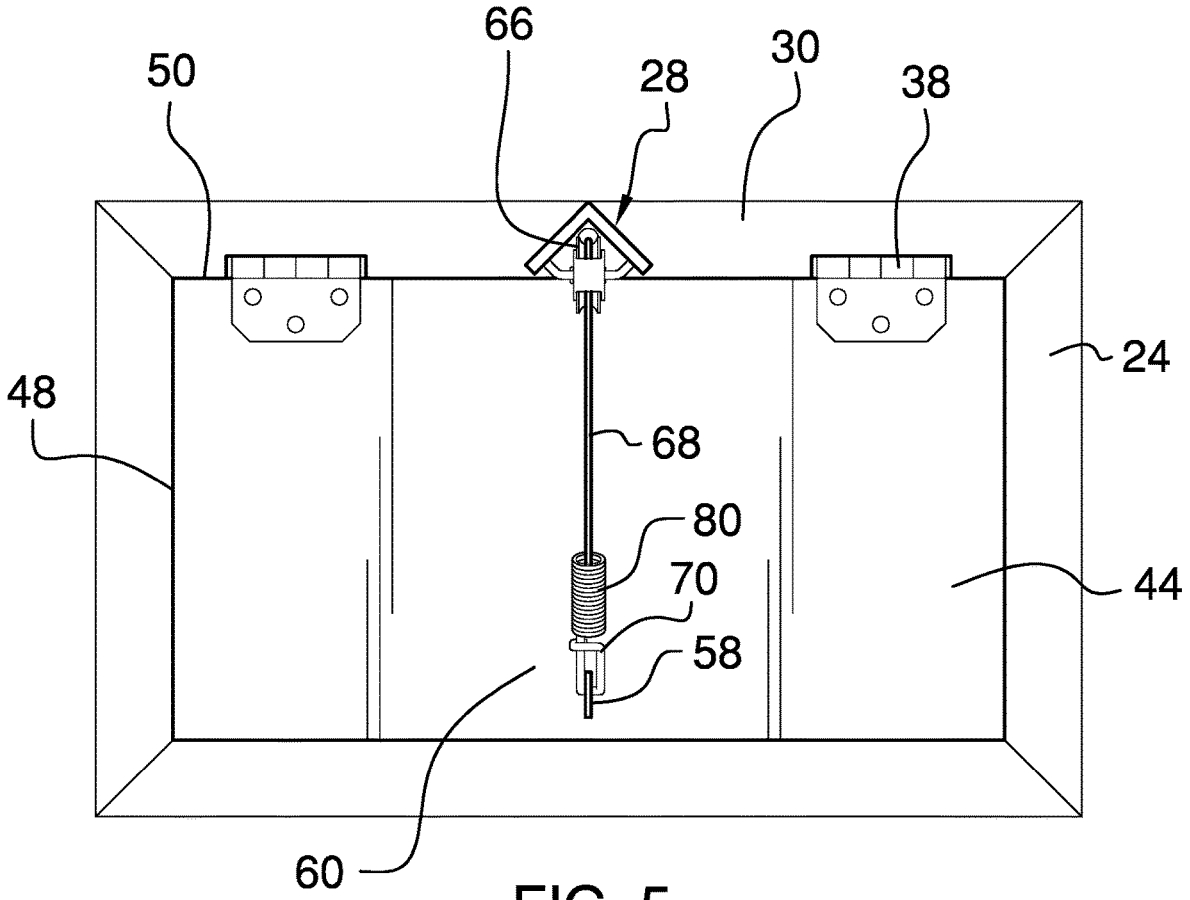
FIG. 5 is a top view of an embodiment of the disclosure.
Figure 6:
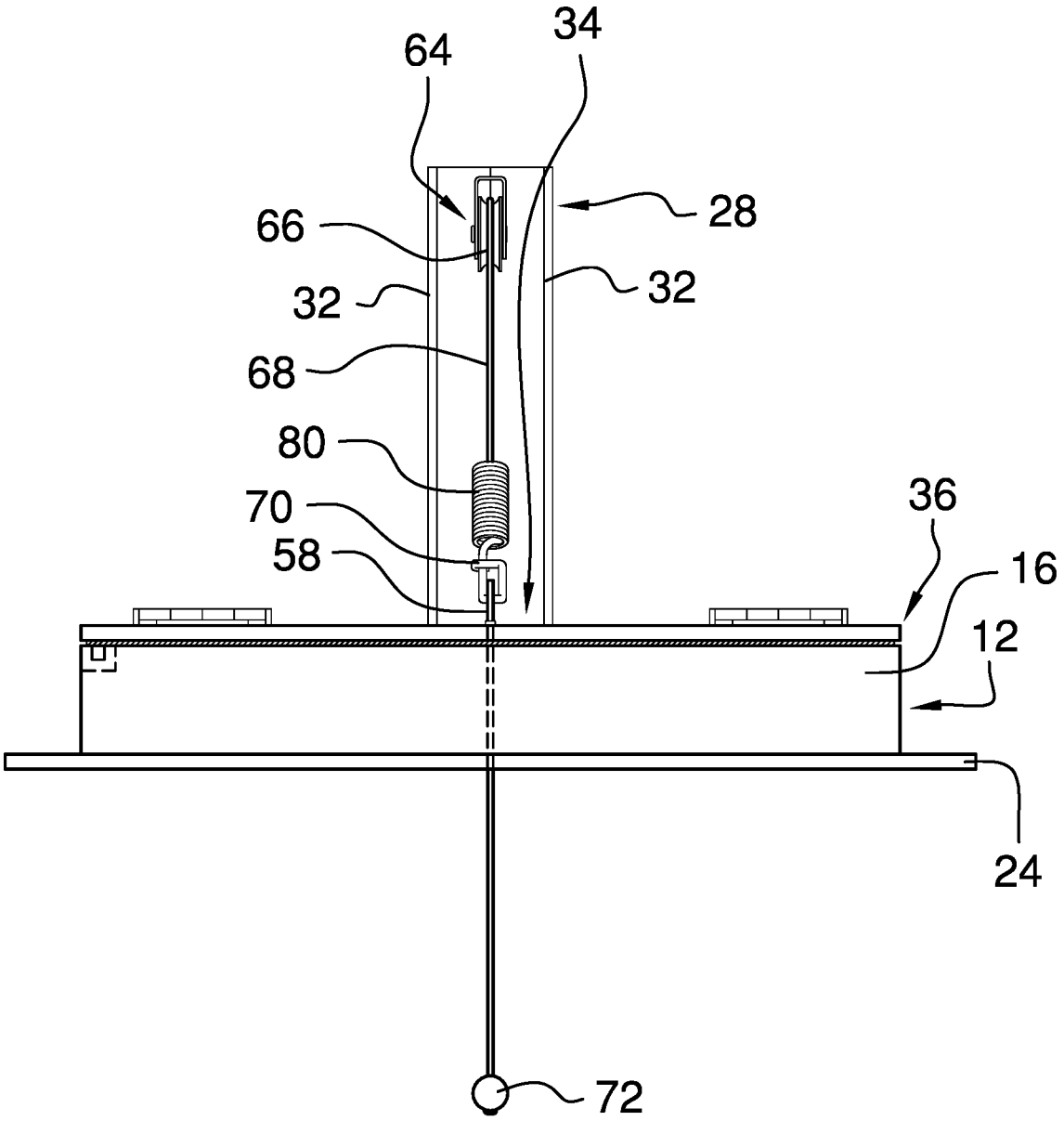
FIG. 6 is a front view of an embodiment of the disclosure.
Figure 7:
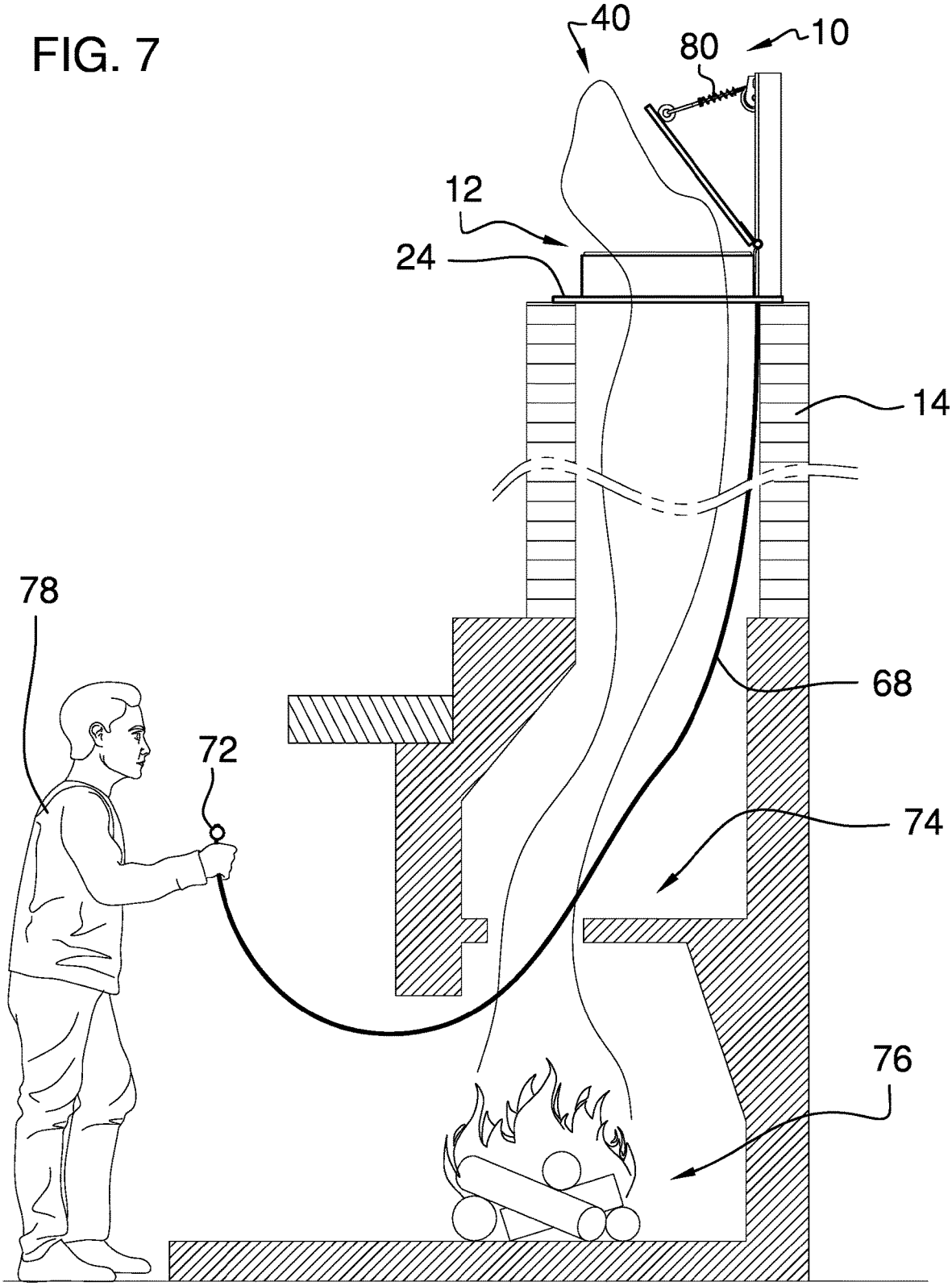
FIG. 7 is an in-use view of an embodiment of the disclosure.

With reference now to the drawings, and in particular to FIGS. 1 through 7 thereof, a new chimney damper embodying the principles and concepts of an embodiment of the disclosure and generally designated by the reference numeral 10 will be described.

As best illustrated in FIGS. 1 through 7, the chimney damper assembly 10 generally comprises a frame 12 configured for mounting to a top of a chimney 14. The frame 12 is hollow and includes a boundary wall 16 having a top edge 18 and a bottom edge 20 each being open. The boundary wall 16 has a rectangular configuration corresponding to a common chimney shape. The boundary wall 16 may have a circular configuration to correspond to cylindrical chimney shapes. The top edge 18 has a trough 22 extending downwardly into the boundary wall 16. The bottom edge 20 of the frame 12 has a rim 24 extending outwardly from the boundary wall 16. The rim 24 is configured for abutting an upper edge 26 of the chimney 14, wherein the rim 24 inhibits the frame 12 from falling into the chimney 14.

A flange 28 extends upwardly the frame 12 and is positioned on a side section 30 of the rim 24. The flange 28 is V-shaped and includes a pair of adjacent walls 32 extending outwardly from a juncture 33. The adjacent walls 32 face towards the boundary wall 16 of the frame 12. The flange 28 has a channel 34 extending downwardly between the adjacent walls 32 and through the rim 24.

A panel 36 is pivotally coupled to the frame 12 by a hinge 38. The panel 36 is pivotally positionable from an open position 40 wherein the panel 36 allows access through the boundary wall 16 of the frame 12 to a closed position 42 wherein the panel 36 inhibits access through the boundary wall 16 of the frame 12. The panel 36 has a first surface 44 and a second surface 46, and the first surface 44 is parallel to the second surface 46. The second surface 46 is abuttable to the top edge 18 of the boundary wall 16. The panel 36 has a perimeter edge 48, and the hinge 38 pivotally couples a rear section 50 of the perimeter edge 48 to a back section 52 of the top edge 18 of the boundary wall 16. The back section 52 of the boundary wall 16 is positioned adjacent to the side section 30 of the rim 24.

The closed position 42 is defined by the second surface 46 of the panel 36 abutting the top edge 18 of the boundary wall 16. The open position 40 is defined by the second surface 46 and a lateral plane 54 of the top edge 18 forming an acute angle 56 facing outwardly from the hinge 38. A loop connector 58 is attached the panel 36. The loop connector 58 is positioned on the first surface 44 of the panel 36 and is proximate to a front section 60 of the panel 36. A seal 62 is attached to the frame 12 and is configured to inhibit ventilation between the panel 36 and the top edge 18 of the boundary wall 16 when the panel 36 is positioned in the closed position 42. The seal 62 comprises a rope mounted within the trough 22 of the top edge 18. The rope abuts the second surface 46 of the panel 36 in the closed position 42. The rope is a fluid impervious material such as rubber or any other fluid impervious material configured to inhibit airflow.

A pulley 64 includes a grooved wheel 66 rotatably coupled to the flange 28. A tether 68 is positioned upon the grooved wheel 66 and is elongated from a first end 70 to a second end 72. The first end 70 of the tether 68 is attached to the loop connector 58 on the panel 36. The second end 72 of the tether 68 extends downwardly through a channel 34 of the flange 28 and is configured for extending down a chimney chute 74 into a fireplace 76. The second end 72 of the tether 68 is configured for being pulled by a user 78 to lift the panel 36 into the open position 40.

A bumper 80 is coupled to the first end 70 of the tether 68. The bumper 80 inhibits the panel 36 from abutting the flange 28 when the panel 36 is positioned into the open position 40. The bumper 80 comprises a spring enwrapping the tether 68. The spring compresses between the loop connector 58 and the flange 28 when the second end 72 of the tether 68 is pulled wherein the first end 70 of the tether 68 moves towards the grooved wheel 66 attached to the flange 28.

In use, the frame 12 is mounted to the top of the chimney 14. The second end 72 of the tether 68 is positioned in the fireplace 76 of the chimney 14 and the first end 70 of the tether 68 is attached to the loop connector 58 of the panel 36. The user 78 pulls on the second end 72 of the tether 68 to lift the panel 36 into the open position 40 wherein the chimney chute 74 is ventilated. The second end 72 of the tether 68 may be secured to an anchored object such as a mantel above the fireplace 76 so that the panel 36 is retained in the open position 40. A fire may be lit in the fireplace 76 thereafter such that the smoke will escape through the top of the chimney 14. The second end 72 may be released after the fire in the fireplace 76 is finished to position the panel 36 into the closed position 42 wherein the heat created by the fire in the house will not escape from the top of the chimney 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chimney damper assembly configured for opening and closing access through a chimney, said chimney damper assembly comprising:

a frame being configured for mounting to a top of a chimney, said frame being hollow and including a boundary wall having a top edge and a bottom edge each being open;

a flange extending upwardly said frame;

a panel being pivotally coupled to said frame by a hinge, said panel being pivotally positionable from an open position wherein said panel allows access through said boundary wall of said frame to a closed position wherein said panel inhibits access through said boundary wall of said frame;

a loop connector being attached said panel;

a seal being attached to said frame, said seal being configured to inhibit ventilation between said panel and said top edge of said boundary wall when said panel is positioned in said closed position;

a pulley including a grooved wheel rotatably coupled to said flange, a tether being positioned upon said grooved wheel and being elongated from a first end to a second end, said first end of said tether being attached to said loop connector on said panel, said second end of said tether is configured for being pulled by a user to lift said panel into said open position; and a bumper being coupled to said first end of said tether, said bumper inhibiting said panel from abutting said flange when said panel is positioned into said open position.

2. The chimney damper assembly of claim 1, wherein said boundary wall has a rectangular configuration, said top edge having a trough extending downwardly into said boundary wall, said bottom edge of said frame having a rim extending outwardly from said boundary wall, said rim being configured for abutting an upper edge of the chimney, wherein said rim inhibits said frame from falling into said chimney.

3. The chimney damper assembly of claim 1, wherein said flange is positioned on a side section of said rim, said flange being V-shaped and including a pair of adjacent walls extending outwardly from a juncture, said adjacent walls facing towards said boundary wall of said frame, said flange having a channel extending downwardly between said adjacent walls and through said rim.

4. The chimney damper assembly of claim 3, wherein said panel has a first surface and a second surface, said first surface being parallel to said second surface, said second surface being abuttable to said top edge of said boundary wall, said panel having a perimeter edge, said hinge pivotally coupling a rear section of said perimeter edge to a back section of said top edge of said boundary wall, said back section of said boundary wall being positioned adjacent to said side section of said rim, said closed position being defined by said second surface of said panel abutting said top edge of said boundary wall, said open position being defined by said second surface and a lateral plane of said top edge forming an acute angle facing outwardly from said hinge.

5. The chimney damper assembly of claim 1, wherein said loop connector is positioned on a first surface of said panel and is proximate to a front section of said panel.

6. The chimney damper assembly of claim 1, wherein said seal comprises a rubber rope being mounted within a trough of said top edge, said rubber rope abutting a second surface of said panel in said closed position.

7. The chimney damper assembly of claim 1, wherein said second end of said tether extends downwardly through a channel of said flange and is configured for extending down a chimney chute into a fireplace, said second end of said tether is configured for being pulled by a user to lift said panel into said open position.

8. The chimney damper assembly of claim 1, wherein said bumper comprises a spring enwrapping said tether, said spring compressing between said loop connector and said flange when said second end of said tether is pulled wherein said first end of said tether moves towards said grooved wheel attached to said flange.

9. A chimney damper assembly configured for opening and closing access through a chimney, said chimney damper assembly comprising:

a frame being configured for mounting to a top of a chimney, said frame being hollow and including a boundary wall having a top edge and a bottom edge each being open, said boundary wall having a rectangular configuration, said top edge having a trough extending downwardly into said boundary wall, said bottom edge of said frame having a rim extending outwardly from said boundary wall, said rim being configured for abutting an upper edge of the chimney, wherein said rim inhibits said frame from falling into said chimney;

a flange extending upwardly said frame, said flange being positioned on a side section of said rim, said flange being V-shaped and including a pair of adjacent walls extending outwardly from a juncture, said adjacent walls facing towards said boundary wall of said frame, said flange having a channel extending downwardly between said adjacent walls and through said rim;

a panel being pivotally coupled to said frame by a hinge, said panel being pivotally positionable from an open position wherein said panel allows access through said boundary wall of said frame to a closed position wherein said panel inhibits access through said boundary wall of said frame, said panel having a first surface and a second surface, said first surface being parallel to said second surface, said second surface being abuttable to said top edge of said boundary wall, said panel having a perimeter edge, said hinge pivotally coupling a rear section of said perimeter edge to a back section of said top edge of said boundary wall, said back section of said boundary wall being positioned adjacent to said side section of said rim, said closed position being defined by said second surface of said panel abutting said top edge of said boundary wall, said open position being defined by said second surface and a lateral plane of said top edge forming an acute angle facing outwardly from said hinge;

a loop connector being attached said panel, said loop connector being positioned on said first surface of said panel and being proximate to a front section of said panel;

a seal being attached to said frame, said seal being configured to inhibit ventilation between said panel and said top edge of said boundary wall when said panel is positioned in said closed position, said seal comprising a rubber rope being mounted within said trough of said top edge, said rubber rope abutting said second surface of said panel in said closed position;

a pulley including a grooved wheel rotatably coupled to said flange, a tether being positioned upon said grooved wheel and being elongated from a first end to a second end, said first end of said tether being attached to said loop connector on said panel, said second end of said tether extending downwardly through said channel of said flange and being configured for extending down a chimney chute into a fireplace, said second end of said tether is configured for being pulled by a user to lift said panel into said open position; and a bumper being coupled to said first end of said tether, said bumper inhibiting said panel from abutting said flange when said panel is positioned into said open position, said bumper comprising a spring enwrapping said tether, said spring compressing between said loop connector and said flange when said second end of said tether is pulled wherein said first end of said tether moves towards said grooved wheel attached to said flange.

* * * * *